United States Patent [19]

Greenberg et al.

[11] 4,025,227

[45] May 24, 1977

[54] VARIABLE AREA TURBINE

[75] Inventors: Paul Burton Greenberg, Manchester; Harry John Kit, Wethersfield, both of Conn.

[73] Assignee: United Technologies Corporation, Hartford, Conn.

[22] Filed: June 30, 1975

[21] Appl. No.: 591,555

[52] U.S. Cl. ..... 415/160

[51] Int. Cl.[2] ..... F01D 17/14

[58] Field of Search ..... 415/151, 149, 147, 160, 415/134, 116, 148

[56] References Cited

UNITED STATES PATENTS

| | | | |
|---|---|---|---|
| 2,651,492 | 9/1953 | Feilden | 415/160 |
| 2,778,564 | 1/1957 | Halford et al. | 415/149 |
| 2,950,084 | 8/1960 | Perry | 415/160 |
| 3,074,690 | 1/1963 | Henny | 415/149 |
| 3,224,194 | 12/1965 | DeFoe et al. | 415/160 |
| 3,367,628 | 2/1968 | Fitton | 415/160 |
| 3,542,484 | 11/1970 | Mason | 415/160 |
| 3,558,237 | 1/1971 | Wall, Jr. | 415/134 |
| 3,582,231 | 6/1971 | Zerlauth | 415/160 |
| 3,652,177 | 3/1972 | Loebel | 415/116 |
| 3,663,118 | 5/1972 | Johnson | 415/147 |
| 3,674,377 | 7/1972 | Trappmann | 415/147 |
| 3,695,777 | 10/1972 | Westphal et al. | 415/143 |

*Primary Examiner*—Henry F. Raduazo
*Attorney, Agent, or Firm*—Robert C. Walker

[57] ABSTRACT

Apparatus for varying the nozzle area in the turbine section of a gas turbine engine is disclosed. Nozzle guide vanes extend across the flow path for the working medium gases and are rotatable to alter the area of the nozzle. In one embodiment the rotatable vanes are cantilevered from the outer engine case and are opposed at their radially inner ends by a shroud which is affixed to the inner engine case.

16 Claims, 2 Drawing Figures

10
12
2
80
78
74
70
72
64
76
66
68
62
16
18
30
66
20
26
24
66
58
28
26
60
A
42
44
22
56
32
34
34
40
52
36
50
48
46
54
14
2

12
80
58
78
76
70
20
A
44
56
32
32
36
46
50

VARIABLE AREA TURBINE

BACKGROUND OF THE INVENTION

The Invention herein described was made in the course of or under a contract with the Department of the Air Force.

FIELD OF THE INVENTION

This invention relates to gas turbine engines and more particularly to engines having nozzle guide vanes which are both rotatable and coolable.

DESCRIPTION OF THE PRIOR ART

In a gas turbine engine of the type referred to above, pressurized air and fuel are burned in a combustion chamber to add thermal energy to the medium gases flowing therethrough. The effluent from the chamber comprises high temperature gases which are flowed downstream in an annular flow path through the turbine section of the engine. Nozzle guide vanes at the inlet to the turbine direct the medium gases onto a multiplicity of blades which extend radially outward from the engine rotor. The nozzle guide vanes are particularly susceptible to thermal damage and are commonly cooled to control the temperature of the material comprising the vanes. Cooling air from the engine compressor is bled through suitable conduit means to an annular chamber which is located radially outward of the working medium flow path and thence to the vanes. The nozzle guide vanes in conventional constructions have platforms which separate the cooling air in the chamber from the working medium gases in the flow path.

Recent efforts to improve the performance of gas turbine engines have led to the development of turbines having variable geometry nozzles. In a typical construction such as that shown in U.S. Pat. No. 3,224,194 to DeFeo et al entitled "Gas Turbine Engine", the area of the turbine nozzle is varied with the engine power level to optimize the flow characteristics of the working medium gases in the region. In DeFeo a plurality of rotatable vanes are positioned circumferentially about the medium flow path to form the turbine nozzle. The ends of each vane are affixed to their respective supporting structure by ball and socket type connectors. The connectors accommodate minor variations in the angle of the vane radial axis which are caused by differential axial expansion between the supporting structures.

Some newly developed engines have incorporated rotatable vanes which are cantilevered from the outer case structure to eliminate the deleterious effects on the vanes of thermal expansion between the cases. Typically, as is shown in U.S. Pat. No. 3,542,484 to Mason entitled "Variable Vanes" and in U.S. Pat. No. 3,652,177 to Loebel entitled "Installation for the Support of Pivotal Guide Blades" the vanes are mounted from the outer case and extend radially inward toward but independently of the inner case. In both constructions the axial gas pressure load on each vane is transmitted to the outer case through a cylindrical bushing which surrounds the stem of the vane. The radial gas pressure load on the vane is transmitted in Mason through a bearing ring to the outer case and in Loebel through the cylindrical bushing to the outer case. An inherent problem with cantilevered vane constructions is the control of medium gas leakage between the tip of each vane and the surrounding shroud at the inner case. The shroud is supported by the inner engine case and is displayed radially according to the thermal response characteristics of the inner case. On the other hand the vanes are supported by the outer case and are displaced radially according to the thermal response characteristics of the outer case. In most constructions a substantial initial clearance is provided to prevent binding between the vanes and the inner shroud under transient conditions with the result that leakage is excessive during nearly all periods of operation.

The leakage problem is particularly acute in high temperatures engines where the relative radial displacement due to thermal expansion is excessive between the inner shroud and the vane tips. Continuing efforts are underway to provide turbine apparatus which in combination with rotatable vanes allows variations in nozzle area with minimized leakage of working medium gases around the tips of the vanes.

SUMMARY OF THE INVENTION

A primary object of the present invention is to provide a variable area nozzle disposed between the inner and outer cases in the turbine section of a gas turbine engine. Another object is to minimize the thermal stresses caused by differential expansion between the inner case and the outer case in the nozzle region. Further objects are to minimize the leakage of working medium gases in the nozzle region and to strategically distribute to the supporting structure the pressure loads exerted by the working medium gases on the nozzle components.

In accordance with the present invention a plurality of guide vanes are cantilevered from the outer engine case in the turbine section of a gas turbine engine and extend radially inward across the flow path for the working medium gases; the vanes engage an inner shroud which is attached to the inner engine case and are radially positioned with respect thereto.

A primary feature of the present invention is the rotatable guide vanes which are cantilevered from the outer engine case to minimize the thermal stresses in the nozzle region. The vanes are radially supported by the inner flow path shroud to control the gap between the vane tips and the shroud. Another feature of the invention is the bearing seat which allows axial and angular movement between each guide vane and the associated inner shroud. A carbon washer, which bears against the seat, is thermally isolated from the medium flow path by support pedestals on the washer housing.

A principal advantage of the present invention is the freedom of the engine inner and outer cases to axially reposition within independent thermal environments without therein imparting significant forces to the nozzle guide vanes which are disposed between the cases. Another advantage of the present invention is the ability to control the clearance between the tip of each nozzle guide vane and the associated inner shroud. Further advantages are the reduced axial gas loading on the cantilevered guide vane and the improved radial sealing between the shroud and the engine inner case, both of which are achieved by axially supporting the inner shroud from the engine inner case independently of the cantilevered vanes.

The foregoing and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
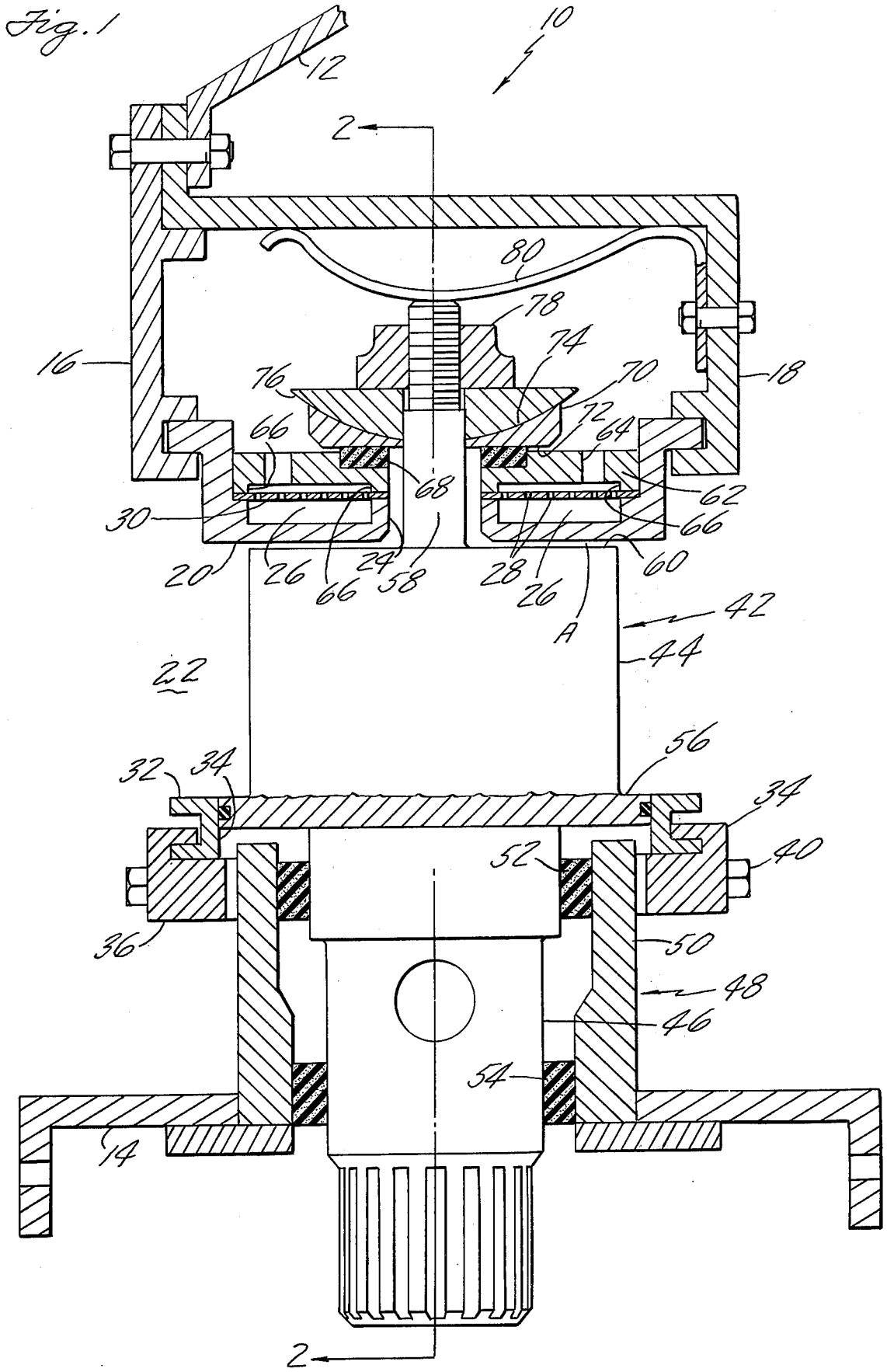
FIG. 1 is a simplified cross section view taken through the portion of the turbine section of a gas turbine engine and shows a rotatably mounted nozzle guide vane included therein.
Figure 2:
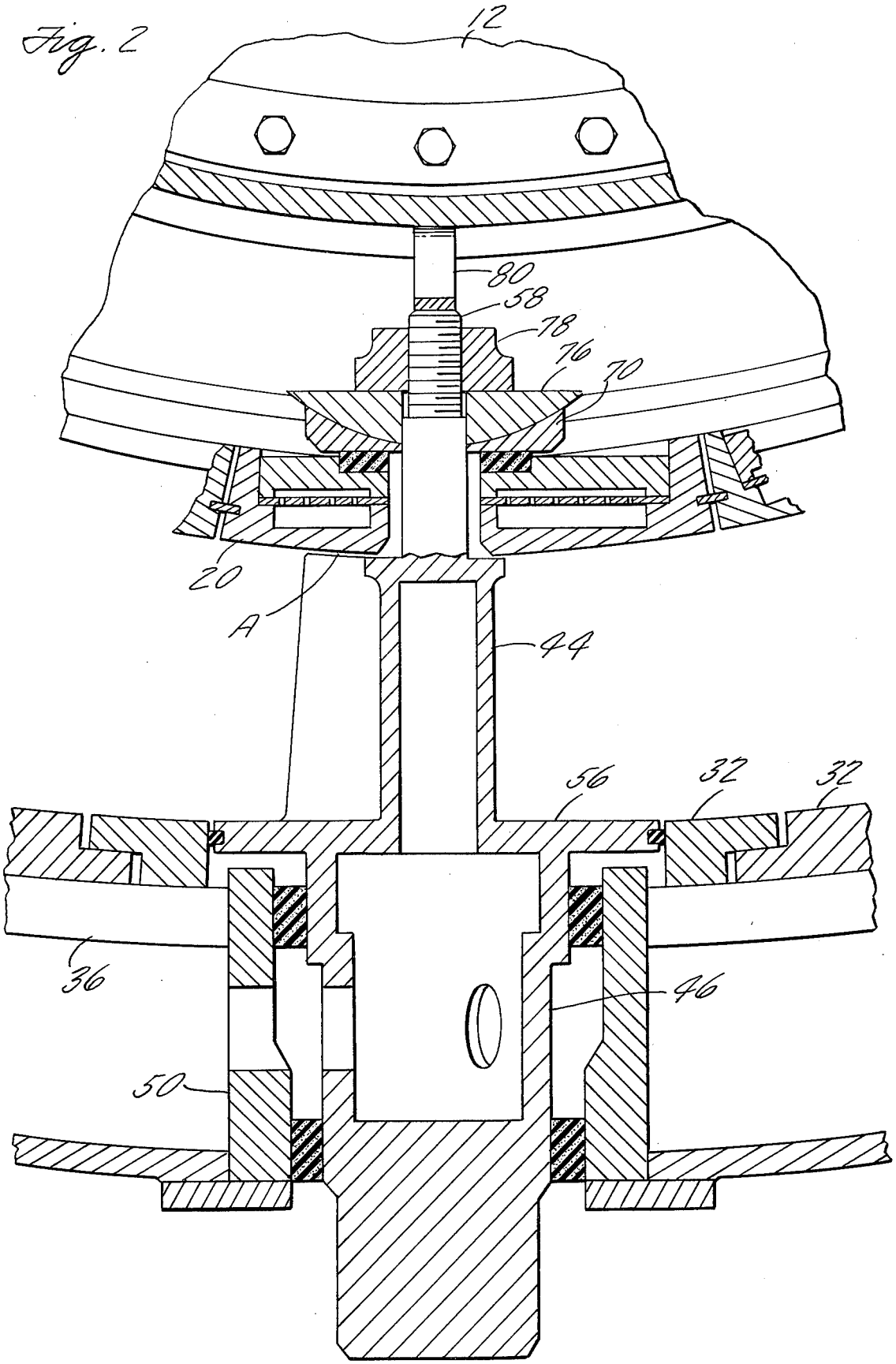
FIG. 2 is a sectional view taken along the line 2—2 as shown in FIG. 1.

A portion of the turbine section 10 of a gas turbine engine is shown in cross section in FIG. 1. The turbine section includes an inner engine case 12 and an outer engine case 14. Extending from the inner engine case is an upstream support 16 and a downstream support 18. The upstream and downstream supports trap an inner shroud 20 therebetween which radially bounds the flow path 22 for the medium gases flowing through the turbine. The inner shroud, which may be segmented, includes a bore 24 extending therethrough. The inner shroud further has cooling cavities 26 which are adapted to receive air flowing through orifices 28 in a cover plate 30.

Radially opposing the inner shroud 20 across the flow path 22 is an outer shroud 32. The outer shroud, which may be segmented, has a cylindrical socket 34 which is radially aligned with the bore 24 of the inner shroud. The outer shroud is trapped between an upstream ring 36 and a downstream ring 38 which are held together by bolting means 40. A turbine vane 42, having an airfoil section 44 extending across the flow path 22 and a stem 46, is rotatably in a bearing cartridge 48. The bearing cartridge, which is affixed to the outer case 14, includes a housing 50. An inner bushing 52 is disposed at one end of the housing and an outer bushing 54 is disposed at the other end of the housing. The bushings are fabricated from a carbonaceous material to provide low friction contact with the vane stem 46. The vane further has a cylindrical platform 56 which engages the cylindrical socket 34 of the outer shroud 32 and a post 58 which penetrates the bore 24 of the inner shroud. A vane tip 60 at the inner end of the airfoil section 44 opposes the inner shroud 20.

A washer housing 62 having cooling passages 64 leading to the plate 30 and support pedestals 66 in contact with the plates 30 contains a thrust washer 68. A bearing seat 70 has a planar surface 72 which is in contact with the washer 68. The washer is fabricated from a carbonaceous material to provide low friction contact with the planar surface. The bearing seat 70 further has a spherically concave surface 74 which is engaged by a spherical bearing 76. A positioning nut 78 is attached to the post 58 and traps the bearing 76 and the bearing seat 70 between the nut and the inner shroud 20. A finger spring 80 which is attached to the downstream support 18 contacts the post 58 to adjust the vane radially outward to maintain the planar surface 72 in contact with the thrust washer 68.

As is viewable in FIG. 1, the radial position of the vane tip 60 with respect to the shroud 20 is adjustable by turning the positioning nut 78 to provide a preferred clearance A. The clearance A is preferably small to minimize the leakage of working medium gases around the tip of the vane without being redirected by the vane. The clearance, however, must be sufficiently large to insure free rotatability of the vane. A clearance of five thousandths (0.005) inches in one embodiment satisfies both requirements.

During operation of the engine the inner engine case 12 and the outer engine case 14 are influenced by differing environments. Relative axial movement between the inner and outer cases is accommodated without inducing stresses in the vanes by relocation of the part 58 within the bore 24. The effects of relative radial growth are likewise diminished in the described construction as the vane 42 is allowed to reposition with respect to the outer case. The cylindrical platform 56 is guided by the socket 34 but is radially slideable therein. Throughout the entire range of engine operation the clearance A remains essentially constant at the value set initially.

The working medium gases exert a radial pressure load on the platform 56 of each vane. The vane, which is radially slideable with respect to the outer case within the bearing cartridge 48 and the socket 34, is radially restrained by means attaching the vane to the inner case. Similarly, the medium gases exert an axial pressure load on the airfoil section 44 of each vane. The vane which is axially and circumferentially slideable with respect to the bore 24 of the inner shroud is axially restrained by means cantilevering the vane from the outer case.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. In a gas turbine engine having a flow path for working medium gases extending through the engine and including a variable area nozzle comprising a plurality of rotatable guide vanes disposed between the inner engine case and the outer engine case, means attached to the outer case for cantilevering free of radial restraint said guide vanes from the outer case to support the vanes under axial loads exerted by the working medium gases on the vanes and means attached to the inner case for radially restraining the vanes under radial pressure loads exerted by the working medium gases on the vanes.

2. In a gas turbine engine having a flow path for working medium gases extending through the engine, a variable area nozzle disposed across the flow path and comprising:

an outer engine case located radially outward of the flow path for the working medium gases;

an inner engine case located radially inward of the flow path for the working medium gases;

an inner shroud which is affixed to the inner case and includes a bore extending therethrough;

an outer shroud which is spaced apart radially from the inner shroud to form a portion of the flow path and which has a cylindrical socket radially aligned with the bore of the inner shroud;

a bearing cartridge extending radially inward from the outer case;

a rotatable guide vane having a stem which engages the bearing cartridge, a cylindrical platform which is interposed within the socket of the outer shroud, an airfoil section extending across the flow path for the working medium gases and a post which penetrates the bore of the inner shroud; and attaching means affixed to the vane post for positioning the vane airfoil section radially with respect to the inner shroud while permitting the vane to reposition axially and circumferentially with respect to the inner shroud.

3. The invention according to claim 2 wherein the bearing cartridge includes an inner cylindrical bushing and an outer cylindrical bushing which are positioned in coaxial alignment with the vane stem by a bearing housing.

4. The invention according to claim 2 wherein the inner shroud has at least one cooling air cavity and wherein cooling air is flowable to the cavity through a plate having a plurality of orifices therein.

5. The invention according to claim 2 wherein the said inner shroud is segmented.

6. The invention according to claim 2 wherein said outer shroud is segmented.

7. The invention according to claim 2 wherein the inner shroud contains a washer housing having a thrust washer mounted therein wherein the washer is positioned in concentric relationship to the bore of the inner shroud and wherein the washer is adapted to receive the radial pressure load exerted by the working medium gases on said rotatable vane during operation of the engine.

8. The invention according to claim 7 which further includes a bearing seat disposed between said attaching means and the thrust washer wherein the bearing seat has a planar surface which opposes the thrust washer.

9. The invention according to claim 8 which further includes a spherical bearing disposed between the bearing seat and the attaching means wherein the bearing has a convex spherical surface and where the seat has a concave spherical surface which opposes the convex spherical surface of the bearing.

10. The invention according to claim 2 wherein said attaching means is a positioning nut which is adjustable on the vane post to selectively adjust the clearance between the vane airfoil section and the inner shroud.

11. The invention according to claim 10 which further includes in contact with the vane post a finger spring which is adapted to adjust the vane radially outward to maintain the clearance between the vane airfoil section and the inner shroud.

12. The invention according to claim 7 wherein the washer housing has a plurality of pedestals which support the housing in relationship to the inner shroud to thermally isolate the thrust washer in the housing from the inner shroud.

13. The invention according to claim 7 wherein the thrust washer is manufactured from a carbonaceous material.

14. The invention according to claim 3 wherein the inner cylindrical bushing and outer cylindrical bushing of the bearing cartridge are fabricated from a carbonaceous material.

15. In a gas turbine engine having a flow path for working medium gases extending through the engine and including a variable area nozzle disposed across the flow path comprising a plurality of rotatable guide vanes which are cantilevered from the outer engine case and are radially opposed at their inner tips by an inner shroud, a method for controlling the radial clearance between the vane tips and the inner shroud comprising the step of:

affixing each vane to the inner shroud in a manner imposing radial restraint against the pressure load of the working medium gases on the vane while permitting the vane tip to reposition axially and circumferentially with respect to the inner shroud.

16. The method according to claim 15 wherein a positioning nut which is adjustable to vary the clearance between the vane and the inner shroud affixes the vane to the inner shroud.

* * * * *